US008523086B2

(12) United States Patent
Warchola

(10) Patent No.: US 8,523,086 B2
(45) Date of Patent: Sep. 3, 2013

(54) METHOD AND APPARATUS FOR STOPPING A SPREADER

(75) Inventor: Marty Warchola, Cleveland, OH (US)

(73) Assignee: Meyer Products, LLC, Cleveland, OH (US)

( * ) Notice: Subject to any disclaimer, the term of this patent is extended or adjusted under 35 U.S.C. 154(b) by 683 days.

(21) Appl. No.: 12/823,756

(22) Filed: Jun. 25, 2010

(65) Prior Publication Data

US 2011/0006128 A1 Jan. 13, 2011

Related U.S. Application Data

(60) Provisional application No. 61/220,716, filed on Jun. 26, 2009.

(51) Int. Cl.
*E01C 19/20* (2006.01)
*B05B 17/04* (2006.01)

(52) U.S. Cl.
USPC ..... 239/7; 239/677; 239/684; 239/687

(58) Field of Classification Search
USPC ..... 239/7, 650, 661, 665, 670, 672–675, 239/677, 681, 684, 687
See application file for complete search history.

(56) References Cited

U.S. PATENT DOCUMENTS

| | | | | |
|---|---|---|---|---|
| 3,344,993 | A | 10/1967 | Wilder et al. | |
| 3,395,866 | A * | 8/1968 | Sousek et al. | 239/670 |
| 3,550,866 | A | 12/1970 | Swenson | |
| 3,776,431 | A * | 12/1973 | Riley | 222/627 |
| 3,869,655 | A * | 3/1975 | Sousek | 318/591 |
| 4,185,224 | A | 1/1980 | Thompson | |
| 4,222,448 | A | 9/1980 | Sunkle et al. | |
| 4,230,280 | A | 10/1980 | Leigh et al. | |
| 4,277,022 | A | 7/1981 | Holdsworth et al. | |
| 4,373,668 | A * | 2/1983 | Forbes et al. | 239/74 |
| 4,523,280 | A | 6/1985 | Bachman | |
| 4,807,375 | A | 2/1989 | Iraci | |
| 5,880,407 | A | 3/1999 | Flammang | |
| 5,901,476 | A | 5/1999 | Buonfiglio | |
| 5,911,362 | A | 6/1999 | Wood et al. | |
| 6,000,577 | A | 12/1999 | Nystrom | |
| 6,089,478 | A * | 7/2000 | Truan et al. | 239/675 |
| 6,851,634 | B2 | 2/2005 | Woodruff et al. | |
| 7,075,019 | B2 | 7/2006 | Bergman et al. | |
| 2005/0121546 | A1 * | 6/2005 | Musso et al. | 239/672 |
| 2006/0049287 | A1 | 3/2006 | Holverson et al. | |
| 2007/0069044 | A1 | 3/2007 | Sandler et al. | |

FOREIGN PATENT DOCUMENTS

| | | | |
|---|---|---|---|
| WO | 2006039928 | A1 | 4/2006 |
| WO | 2007015284 | A2 | 2/2007 |

OTHER PUBLICATIONS

PCT—Notification of Transmittal International Preliminary Report on Patentability, Oct. 10, 2011.
PCT—International Preliminary Report on Patentability, Oct. 10, 2011.
International Search Report and Written Opinion on Patentability, dated Dec. 30, 2010, PCT/US2010/040057.

* cited by examiner

*Primary Examiner* — Darren W Gorman
(74) *Attorney, Agent, or Firm* — Roger D. Emerson; Timothy D. Bennett; Emerson Thomson Bennett

(57) ABSTRACT

The invention is directed at devices and methods for regulating the operation of a spreader assembly's particulate material distribution in response to changing vehicle conditions.

17 Claims, 8 Drawing Sheets

METHOD AND APPARATUS FOR STOPPING A SPREADER

This application claims priority to a provisional patent application filed Jun. 26, 2009, entitled METHOD AND APPARATUS FOR STOPPING A SPREADER, having Ser. No. 61/220,716, which is hereby incorporated by reference.

I. BACKGROUND OF THE INVENTION

A. Field of Invention

This invention pertains to the art of spreader assemblies used to spread salt and/or sand onto road surfaces, and more specifically to methods and apparatuses for stopping a spreader assembly when the vehicle to which it is mounted slows down or changes direction.

B. Description of the Related Art

Salt and/or sand spreading is a common practice to maintain roads, parking spaces, and other ground surfaces during the winter months. It is known to use larger vehicles as well as smaller vehicles, such as pickup trucks, to perform this type of service. Numerous types of spreaders have been developed to be attached to conventional vehicles. Typically, the spreader is attached to the rear of the vehicle to spread particulate material, such as salt, sand, cinders, etc. onto the ground surface being traveled by the vehicle. One of the more common spreaders employs a hopper having a lower discharge opening through which the particulate material falls onto a rotating spinner plate. By rotating the spinner plate as material is being discharged onto the spinner plate, the particulate material is centrifugally propelled by the spinner plate in a wide pattern onto the ground surface. Typically, a spinner mechanism motor is mounted on the spreader to cause the spinner plate to rotate. Typical spreader attachment assemblies used in conjunction with pick-up trucks fasten the spreader to the truck's rear bumper or tailgate.

While many spreaders work well for their intended purpose, one problem known in the art concerns the circumstance when the vehicle to which the spreader is attached significantly slows down, stops, or changes direction—such as from a frontward direction to a rearward direction. One non-limiting example of this is when a vehicle that is spreading material onto a road surface comes to a traffic light or stop sign and thus must slow considerably and/or come to a full stop. In these circumstances it may be desirable to reduce or stop the material that is being spread onto the ground surface to prevent excessive material from being spread in too great of a concentration over a given ground surface area.

What is needed is a spreader assembly that permits the spreading operation to be reduced or stopped when the vehicle to which it is mounted slows, stops, or is placed into reverse.

II. SUMMARY OF THE INVENTION

According to one embodiment of the invention, a system for spreading particulate materials, comprises: an automotive vehicle; a hopper, adapted to hold particulate materials for distribution over a ground surface; a frame, operatively securing the hopper to the automotive vehicle; a spinner mechanism, the spinner mechanism operatively attached to the hopper and adapted to distribute hopper particulate materials over a ground surface; a spinner mechanism motor, operatively attached to the spinner mechanism, the spinner mechanism motor selectively providing rotational forces to the spinner mechanism; and a controller, operatively connected to the spinner mechanism motor, the controller being adapted to regulate operation of the spinner mechanism motor based on a condition signal received from one or more control signal generators chosen from the group consisting of: a vehicle brake light, a vehicle reverse light, or a vehicle gear shift.

According to another embodiment of the invention, a system for spreading particulate materials, comprises: an automotive vehicle having a truck bed; a hopper, adapted to be securely received within the truck bed and hold particulate materials for distribution over a ground surface, the hopper having a conveyor belt adapted to be powered by a conveyer belt motor and transfer particulate materials contained within the hopper to a spinner mechanism; a spinner mechanism, the spinner mechanism operatively attached to the hopper and adapted to distribute hopper particulate materials over a ground surface; a motor, operatively attached to the spinner mechanism, the motor selectively providing rotational forces to the spinner mechanism; and a controller, operatively connected to the conveyor belt motor and the spinner mechanism motor, the controller being adapted to regulate operation of the conveyor belt motor and the spinner mechanism motor based on a condition signal received from one or more control signal generators chosen from the group consisting of: a vehicle brake light, a vehicle reverse light, or a vehicle gear shift.

According to yet another embodiment of the invention, a method for spreading particulate materials, comprises the steps of: (A) providing an automotive vehicle; a hopper, adapted to hold particulate materials for distribution over a ground surface; a frame, operatively securing the hopper to the automotive vehicle; a spinner mechanism, the spinner mechanism operatively attached to the hopper and adapted to distribute hopper particulate materials over a ground surface; a spinner mechanism motor, operatively attached to the spinner mechanism, the spinner mechanism motor selectively providing rotational forces to the spinner mechanism; and a controller, operatively connected to the spinner mechanism motor, the controller being adapted to regulate operation of the spinner mechanism motor based on a condition signal received from one or more control signal generators chosen from the group consisting of: a vehicle brake light, a vehicle reverse light, or a vehicle gear shift; (B) using the control signal generators to provide a condition signal in response to a change in vehicle condition; (C) transmitting the condition signal to the controller; (D) using the controller to process the condition signal to determine to what extent power to the spinner mechanism motor should be adjusted; and, (E) using the controller to adjust the power provided to the spinner mechanism motor to a level within the range of no power to full power; and, (F) repeating steps (a) through (e) according to a predetermined operational protocol to detect the presence of a condition signal.

One advantage of this invention according to one embodiment is that a spreader can be easily controlled based on the status of the vehicle brake light.

Another advantage of this invention according to another embodiment is that a spreader can be easily controlled based on the status of the vehicle reverse light.

Yet another advantage of this invention according to yet another embodiment is that a spreader can be easily controlled based on the status of the vehicle gear shift.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION OF THE INVENTION

Figure 1:
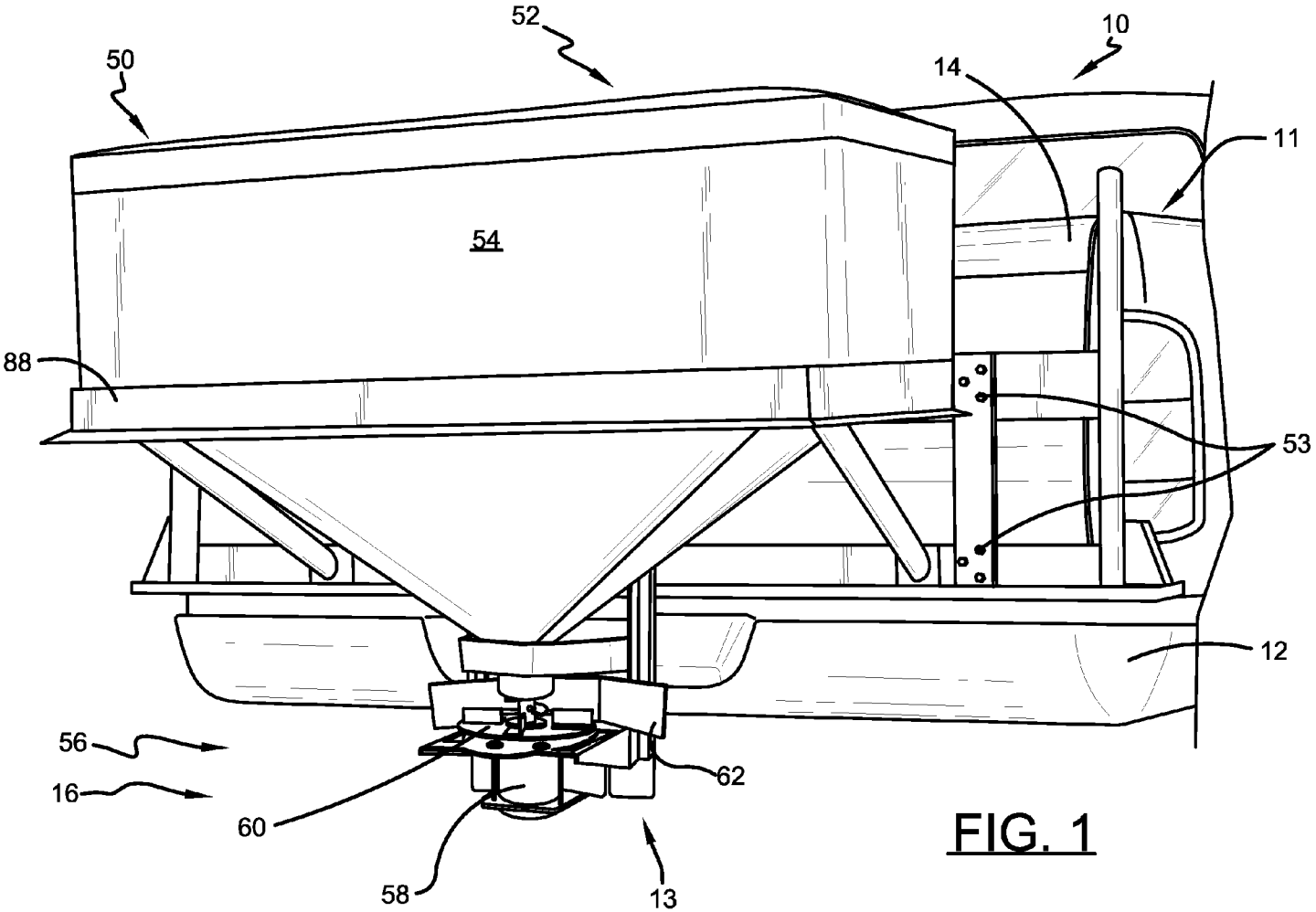
FIG. 1 is a back view of a spreader assembly according to one embodiment of this invention shown attached to the back portion of a vehicle.
Figure 7:
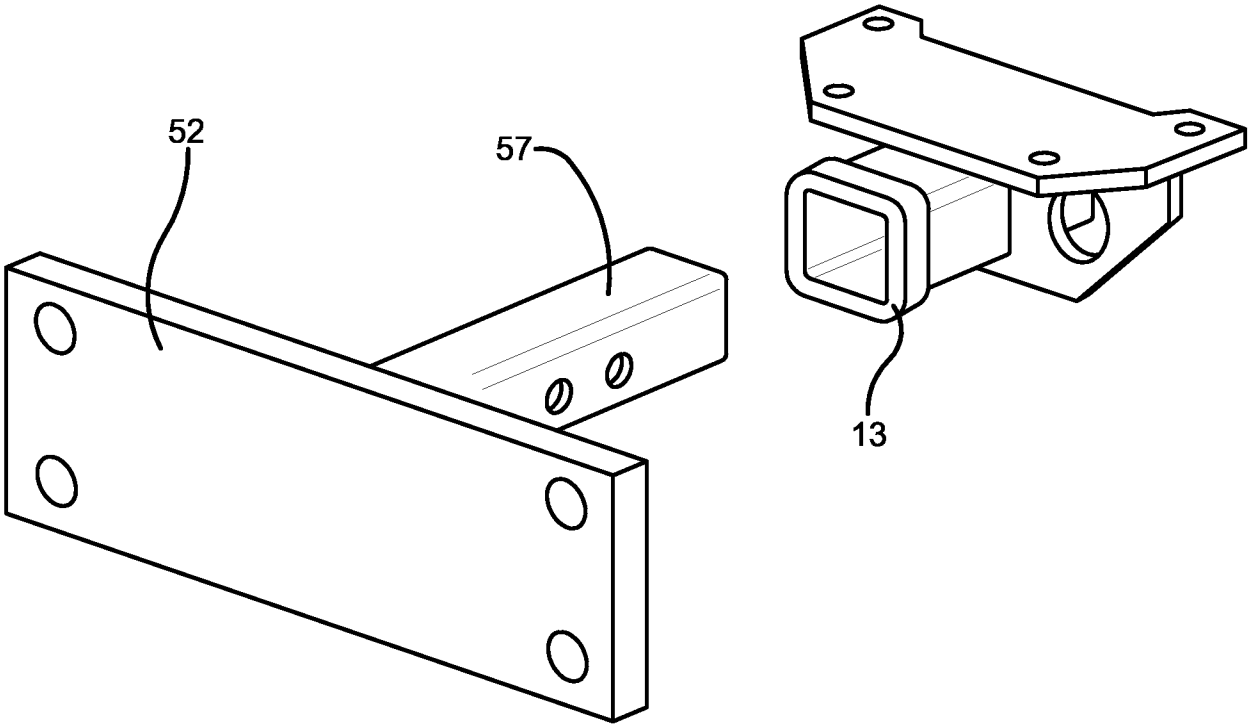
FIG. 7 is a schematic diagram showing a hopper frame having a known hitch connector that secures the frame to a vehicle hitch.

Referring now to the drawings wherein the showings are for purposes of illustrating embodiments of the invention only and not for purposes of limiting the same, FIG. 1 shows a system for spreading particulate materials, according to one embodiment of this invention, having a spreader assembly 50 attached to the back end of an automotive vehicle 10. While the vehicle 10 shown is commonly known as a pick-up truck it should be noted that this invention will work with any vehicle chosen with the sound judgment of a person of skill in the art. The vehicle 10 may include a truck bed 11, bumper 12, tailgate 14 and hitch 13 illustrated in FIG. 7. Because the spreader assembly 50 shown in FIG. 1 is attached to the back end of a pick-up truck having a tailgate 14, it is commonly referred to as a tailgate spreader. However, it should be noted that this invention will work with any spreader assembly chosen with the sound judgment of a person of skill in the art. Indeed, according to some embodiments of the invention, described below, an insert hopper configuration is utilized.

With reference now to FIGS. 1-3 and 7, the spreader assembly 50 may include a frame 52 that is attachable to the vehicle 10, a hopper 54 supported to the frame 52 for use in holding a particulate material to be spread, and a spinner mechanism 56 supported to the frame 52 and operatively attached to the hopper 54 to spread the material held in the hopper 54 onto any appropriate ground surface 16 including roads, parking spaces, drive ways, sidewalks, and the like. The frame 52 may include a hopper support member 88 to assist in supporting the hopper 54. In various embodiments, the frame 52 supports the hopper 54 and spreader assembly 50 to the vehicle tailgate 14 (using, for example, openings that receive connectors 53, as shown in FIG. 1), vehicle bumper 12 (using, for example, plate 55 shown in FIGS. 2 and 2A that rests on the bumper 12 as shown in FIG. 1 ), or vehicle bumper hitch 13 (using, for example, hitch connector 57 shown schematically in FIG. 7 ). The particulate material held in the hopper 54 which is to be spread onto the ground surface 16 can be any appropriate for winter weather use chosen with the sound judgment of a person of skill in the art. Some non-limiting examples include salt, sand, and cinders. The hopper 54 can be of any design and formed of any material chosen with the sound judgment of a person of skill in the art. In one specific embodiment, the hopper 54 is formed of polyethylene and the material held within the hopper 54 is salt.

Figure 2:
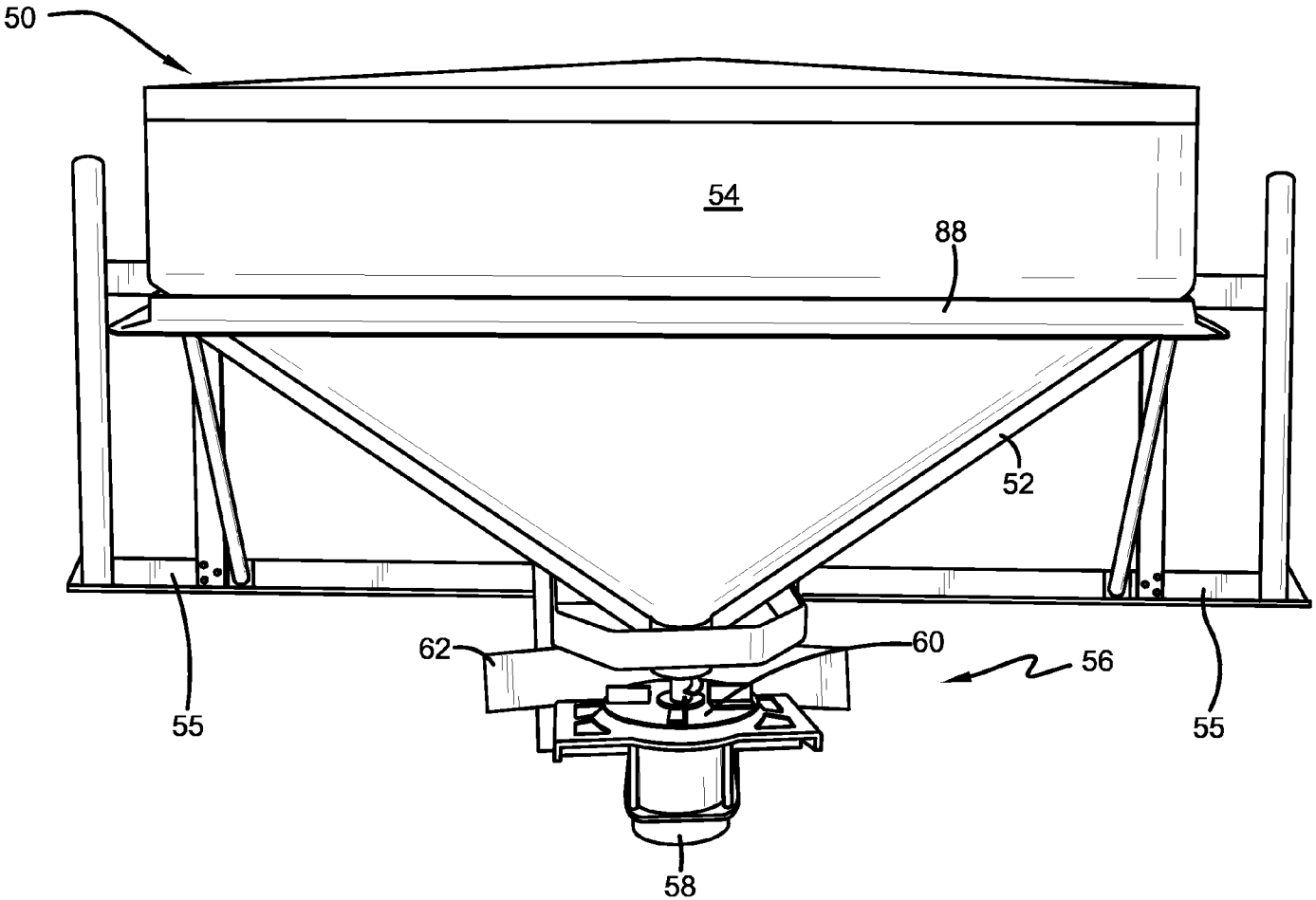
FIG. 2 is a back view of the spreader assembly of FIG. 1 shown detached from the vehicle.
Figure 2A:
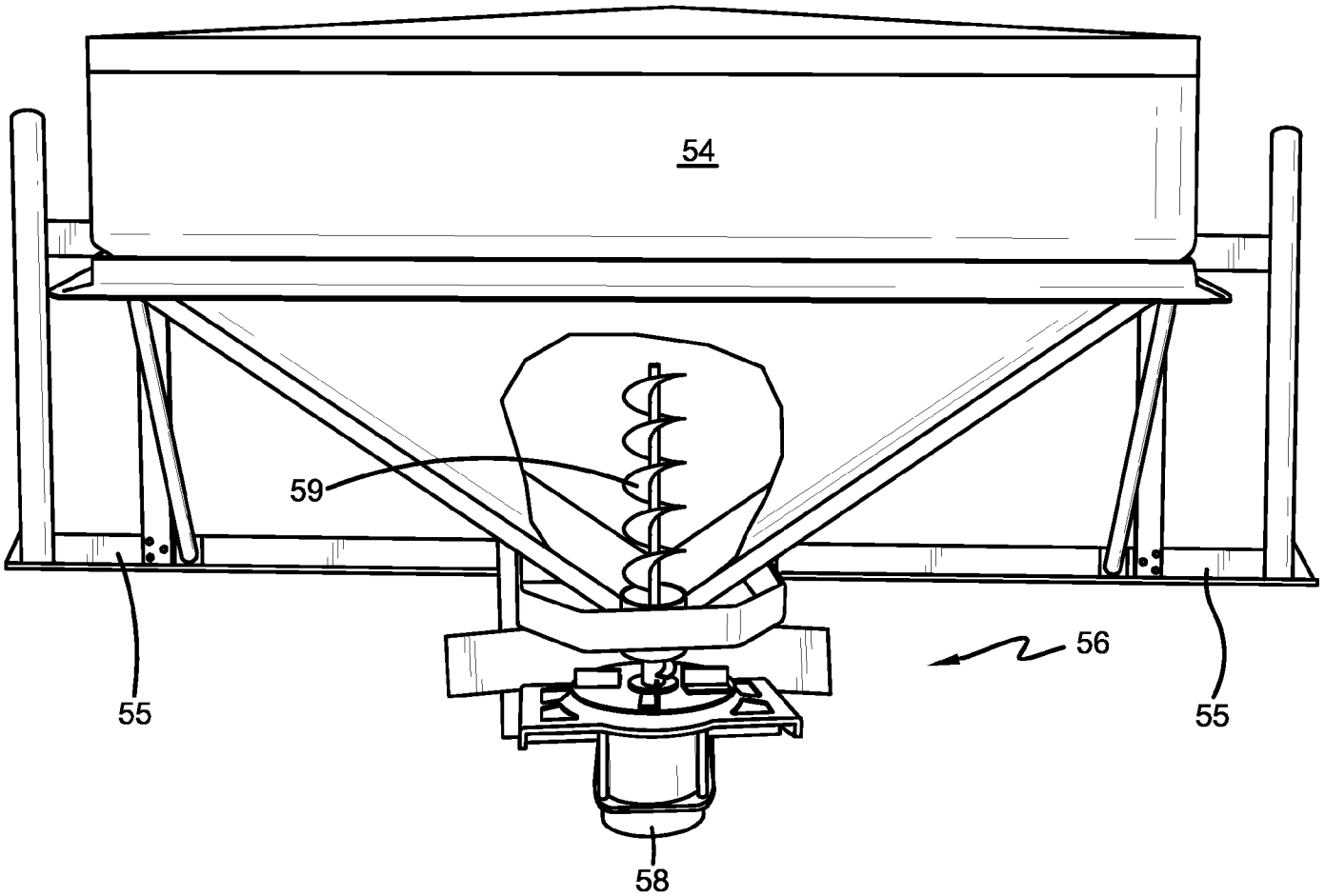
FIG. 2A is a partial cross-sectional view of a spreader assembly having an auger component.
Figure 3:
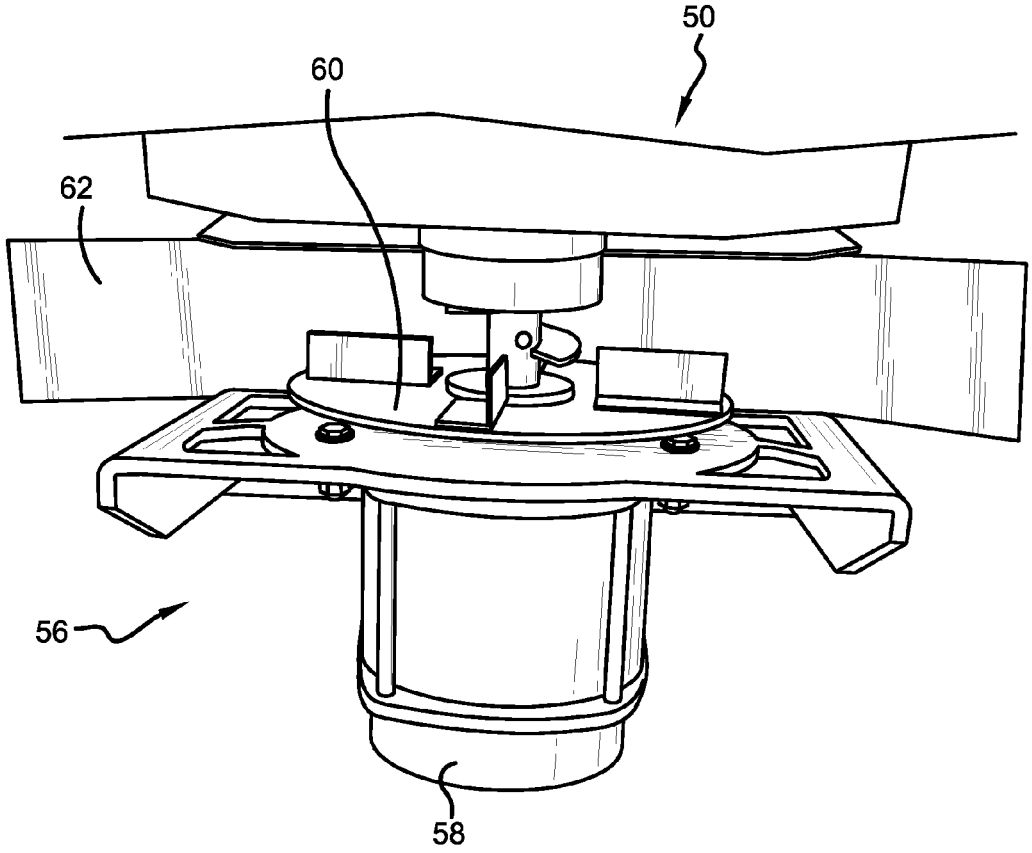
FIG. 3 is a magnified back view of a portion of the spreader assembly shown in FIG. 2.

The spinner mechanism 56 can be of any design chosen with the sound judgment of a person of skill in the art. For the embodiment shown in FIG. 1, the spinner mechanism 56 is operatively attached to a spinner mechanism motor 58 and a spinner plate 60 that is selectively rotatable by the spinner mechanism motor 58 to spread the material held in the hopper 54 onto the ground surface 16. A baffle plate 62 may be used to prevent the material from being propelled toward the vehicle 10. As shown in FIG. 2A, the spinner mechanism 56 can additionally include an auger 59 that is operatively connected with both the spinner mechanism motor 58 and the spinner plate 60. The auger 59 resides in a substantially vertical position at least partially within the hopper 54, and when rotated by forces provided by the spinner mechanism motor 58, turns in a screw-like fashion, well known in the art, so as to transfer particulate materials residing in the hopper 54 to the spinner mechanism 56.

Figure 4:
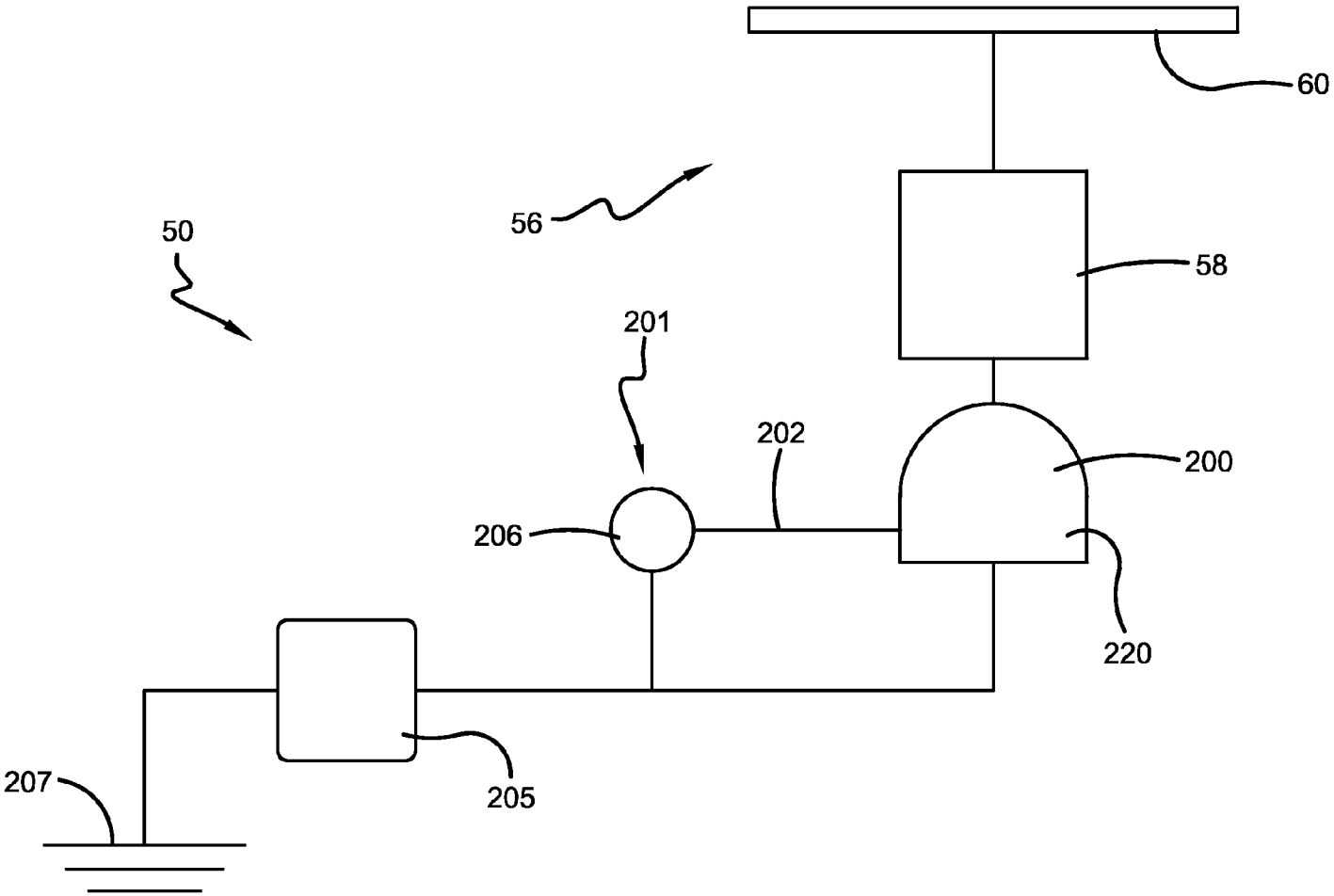
FIG. 4 is a schematic diagram showing certain control embodiments of this invention.
Figure 5:
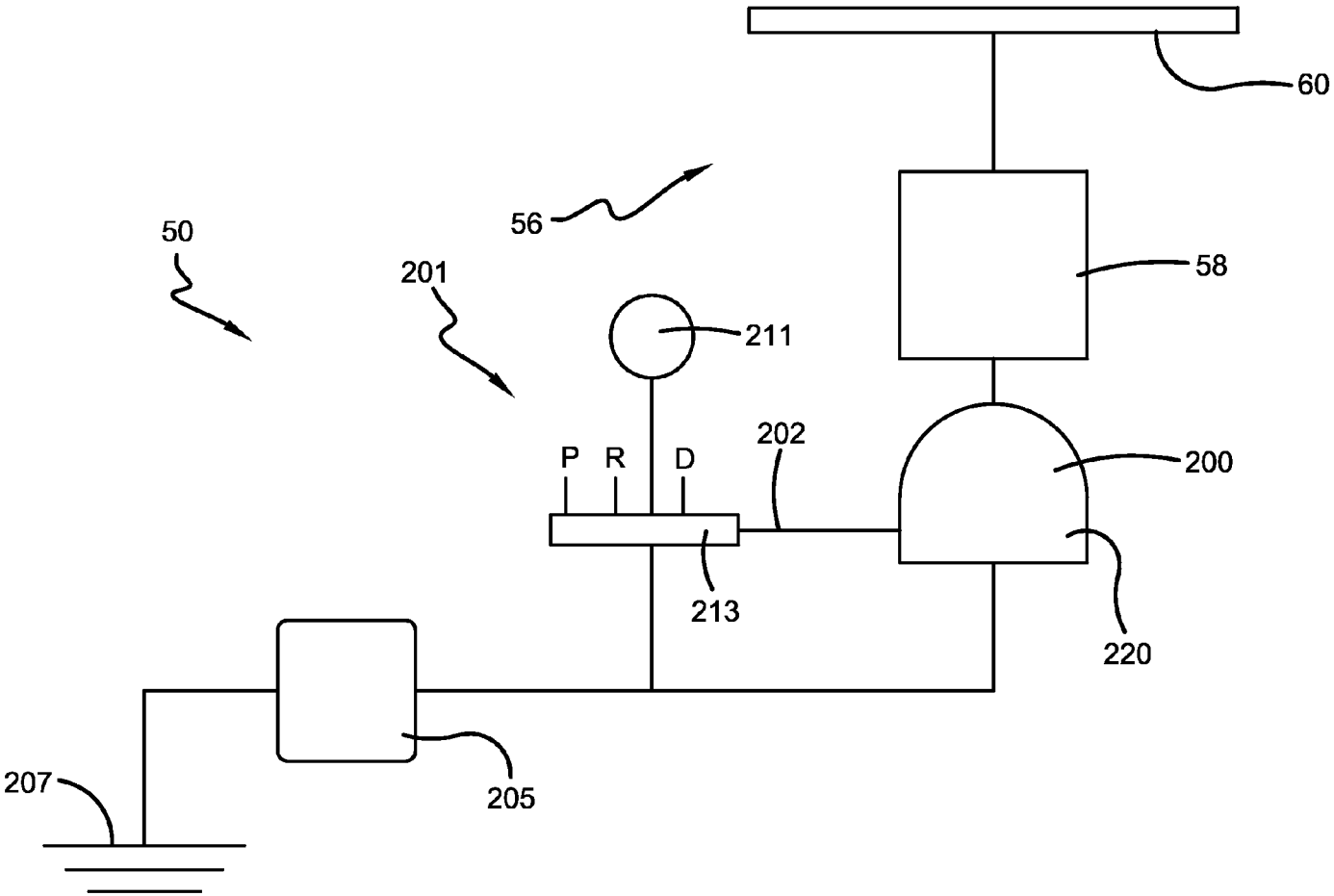
FIG. 5 is a schematic diagram showing certain other control embodiments of this invention.

With reference now to FIGS. 1-5, schematic diagrams of embodiments of the spinner mechanism 56 are shown in FIGS. 4 and 5. Both FIGS. 4 and 5 show a controller 200 which may be of any type chosen with the sound judgment of a person of skill in the art and which may be used to operate the spinner mechanism 56 by virtue of its operative connection to the spinner mechanism motor 58. The controller 200 also may be used for any number and type of controlling functions, including controlling functions beyond the control of the spreader assembly 50, chosen with the sound judgment of a person of skill in the art. The controller 200 may be fixed to an inside surface of the vehicle 10, fixed to an outside surface of the vehicle 10, or non-fixed to any surface and thus readily movable by the operator within and/or without the vehicle 10. In one embodiment, shown, the controller 200 may require "hard wiring" to connect it to the spreader assembly 50 (specifically, the spinner mechanism motor 58) while in another embodiment the controller 200 may be wireless. In one embodiment, the controller 200 may be used to operate the spinner mechanism 56 by controlling the power provided to the spinner mechanism motor 58 (within the range of no power to full power) to thereby control the rotation, or speed of rotation, of the spinner plate 60. The controller 200 may be electrically connected to a battery 205, which is connected to ground 207, to a control signal generator 201, which provides a condition signal 202 to the controller 200, and to the spinner mechanism motor 58 to thereby control the operation of the spinner mechanism 56. For the purposes of this invention, control signal generator 201 can consist of any device capable of generating a condition signal 202; but, with non-limiting reference, shall specifically include a vehicle brake light 206, vehicle reverse light 206, and/or vehicle gear shift 211. As the operation and interconnection of these components, with further explanation on some components provided below, is well known to those of skill in the art, further explanation will not be provided here. However, some non-limiting examples of how some of these components may be interconnected are provided in U.S. Pat. No. 4,807,375 titled PLOWING DEVICE and U.S. Pat. No. 5,901,476 titled PLOW LIFT SYSTEM, both of which are hereby fully incorporated by reference. These references disclose methods and apparatuses for arranging components used to automatically lift a snowplow when the vehicle is placed into reverse but they do not anticipate or suggest any use with spreader systems.

With reference now to FIGS. 4-5, in order to permit the spreading operation to be adjusted when a vehicle 10 condition is changed, the control signal generator 201 provides the condition signal 202 to the controller 200 which then makes the required adjustment to the spreader assembly 50. The control signal generator 201 and the corresponding condition signal 202 may be of any type chosen with the sound judgment of a person of skill in the art. In one embodiment, shown in FIG. 4, the condition signal 202 is generated based on the status of a light 206 that is associated with the vehicle 10. In one specific embodiment, the condition signal 202 is the status of a vehicle brake light 206. As the operation of a vehicle brake light is well known to those of skill in the art, further details will not be provided here. When the brake light 206 is activated (turned "on"; in other words that electric current is flowing through the brake light 206), this indicates that the vehicle operator has pressed the vehicle brake pedal (not shown); a change in vehicle condition that prompts the generation of a condition signal 202. Upon receiving the condition signal 202, the controller 200 can then stop or reduce power to the spinner mechanism motor 58 to thereby stop or reduce rotation of the spinner plate 60 and thus stop or reduce the spreading of material onto the ground surface. Once the operator releases the brake pedal, the brake light 206 goes "off" (in other words, electric current stops flowing through the brake light 206) and the condition signal is terminated. In response to the absence of a condition signal 202, the controller 200 can then return partial or full power to the spinner mechanism motor 58 to thereby increase the rotation of the spinner plate 60 and thus begin or increase the spreading of material onto the ground surface.

With reference now to FIG. 4, in another specific embodiment, the condition signal 202 is generated based on the status of a vehicle reverse light 206. As the operation of a vehicle reverse light is well known to those of skill in the art, further details will not be provided here. When the reverse light 206 is activated (turned "on"; in other words that electric current is flowing through the reverse light 206), this indicates that the vehicle operator has adjusted the vehicle transmission (not shown) into reverse; a change in vehicle condition that prompts the generation of a condition signal 202. Upon receiving the condition signal 202, the controller 200 can then stop or reduce power to the spinner mechanism motor 58 to thereby stop or reduce rotation of the spinner plate 60 and thus stop or reduce the spreading of material onto the ground surface. Once the operator adjusts the vehicle transmission out of reverse, the reverse light 206 goes "off" (in other words, electric current stops flowing through the brake light 206), and the condition signal 202 is terminated. In response to the absence of a condition signal 202, the controller 200 can then return partial or full power to the spinner mechanism motor 58 to thereby increase the rotation of the spinner plate 60 and thus begin or increase the spreading of material onto the ground surface.

With reference now to FIG. 5, in another embodiment, the condition signal 202 is generated based on the status of a vehicle gear shift 211. One or more electric switches 213, for example, may be positioned near the gear shift 211 and thus be able to generate a condition signal 202 upon a change in vehicle condition, said condition signal being communicated to the controller 200 to sense the location or condition of the gear shift 211. The switch(es) 213 may thus be able to sense when the gear shift 211 is in a "drive" condition ("D" as shown), a "reverse" condition ("R" as shown), a "park" condition ("P" as shown), etc. In this way the controller 200 can sense, for example, that the gear shift 211 is in the "drive" condition which indicates that the vehicle operator is driving the vehicle 10 in a normal forward manner. In response to the condition signal 202 generated by a change in vehicle condition to the drive position the controller 200 may permit power to the spinner mechanism motor 58 to thereby provide rotation of the spinner plate 60 to provide the spreading of material onto the ground surface.

With continuing reference to FIG. 5, when the operator adjusts the gear shift 211 into a "reverse" condition, which indicates that the vehicle operator has adjusted the vehicle transmission into reverse, the switch(es) 213 generate a condition signal 202 that is communicated to the controller 200, and as a result may stop or reduce power to the spinner mechanism motor 58 to thereby stop or reduce rotation of the spinner plate 60 and thus stop or reduce the spreading of material onto the ground surface. Once the operator adjusts the vehicle transmission out of reverse and into drive, the switch 213 terminates its communication of the condition signal 202 to the controller 200. In response to the termination of the control signal, the controller 200 can then return partial or full power to the spinner mechanism motor 58 to thereby increase the rotation of the spinner plate 60 and thus begin or increase the spreading of material onto the ground surface.

Still referring to FIG. 5, when the operator adjusts the gear shift 211 into a "park" condition, which indicates that the vehicle operator has adjusted the vehicle transmission into a no motion or park condition, the switch(es) 213 generate a condition signal 202 that is communicated to the controller 200 and may result in a stop or reduction of power to the spinner mechanism motor 58 to thereby stop or reduce rotation of the spinner plate 60 and thus stop or reduce the spreading of material onto the ground surface. Once the operator adjusts the vehicle transmission out of park and into drive, the condition signal 202 coming from the switch associated with the "park" condition is terminated. In the absence of the "park" condition signal 202, the controller 200 may then receive a condition signal from the switch associated with a driving condition, and then return partial or full power to the spinner mechanism motor 58 to thereby increase the rotation of the spinner plate 60 and thus begin or increase the spreading of material onto the ground surface.

With reference now to FIGS. 4 and 5, in yet another embodiment, the controller 200 may also include a timer device 220 which may be used to adjust the timing of the operation of the spreader assembly 50. In one embodiment, for example, the timer device 220 may be used to temporarily delay or suspend the operation of the spinner mechanism motor 58. Thus, in one specific example, when the brake light 206 is activated, indicating that the vehicle operator has pressed the vehicle brake pedal, a condition signal 202 is generated and communicated to the controller 200. The controller 200 can then stop or reduce power to the spinner mechanism motor 58, for a period of time established by the timer device 220, to thereby stop or reduce rotation of the spinner plate 60 and thus stop or reduce the spreading of material onto the ground surface. After the period of time to which the timer device 220 is set is accomplished, the controller 200 can then return partial or full power to the spinner mechanism motor 58 to thereby increase the rotation of the spinner plate 60 and thus begin or increase the spreading of material onto the ground surface. Note that in this example the timer device 220 would restore operation of the spinner plate 60 even if the operator was still pressing the brake pedal and the brake light 206 remained "on."

With continuing reference to FIGS. 4 and 5, in another specific example, the activation of the brake light 206, indicating that the vehicle operator has pressed the vehicle brake pedal, generates a condition signal that is communicated to the controller 200. The controller 200 can then stop or reduce power to the spinner mechanism motor 58 to thereby stop or reduce rotation of the spinner plate 60 and thus stop or reduce the spreading of material onto the ground surface. Once the operator releases the brake pedal, the brake light 206 goes "off" (in other words, electric current stops flowing through the brake light 206), and the condition signal 202 is terminated. In the absence of a condition signal 202, the controller 200 can then, after a delay determined by the timer device 220, return partial or full power to the spinner mechanism motor 58 to thereby increase the rotation of the spinner plate 60 and thus begin or increase the spreading of material onto the ground surface. Note that in this example the timer device 220 would not restore operation of the spinner plate 60 as long as the operator was still pressing the brake pedal and the brake light 206 remained "on."

Still referring to FIGS. 4-5, the timer device 220 can be of any type chosen with the sound judgment of a person of skill in the art. In one embodiment, the timer device 220 is programmable so that the time adjustment can be varied by the manufacturer and/or by the operator. In another embodiment, the timer device 220 may be set differently for different uses (the duration that the timer device 220 suspends operation is dependent on which control signal generator provides the condition signal 202). The time delay for a condition signal generated by activation of the brake light, for example, may be 1.0 second, while the delay for a condition signal generated by activation of the reverse light may be 3.0 seconds. In yet another embodiment, multiple timer devices may be used.

According to yet another embodiment of the invention, a method for spreading particulate materials is provided. Said method utilizes the same spreader assembly 50 components, and their respective interactions with device components described above, to generate a condition signal in response to a change in vehicle condition that regulates the operation of particulate material distribution onto a ground surface. Said method can repeat the interactions, detailed above, according to any predetermined operational protocol that is chosen by a person of ordinary skill in the art, to detect the presence or absence of a condition signal 202 in a manner that permits the spreader assembly to regulate the distribution of particulate materials based on continuing changes in vehicle condition.

Figure 6:
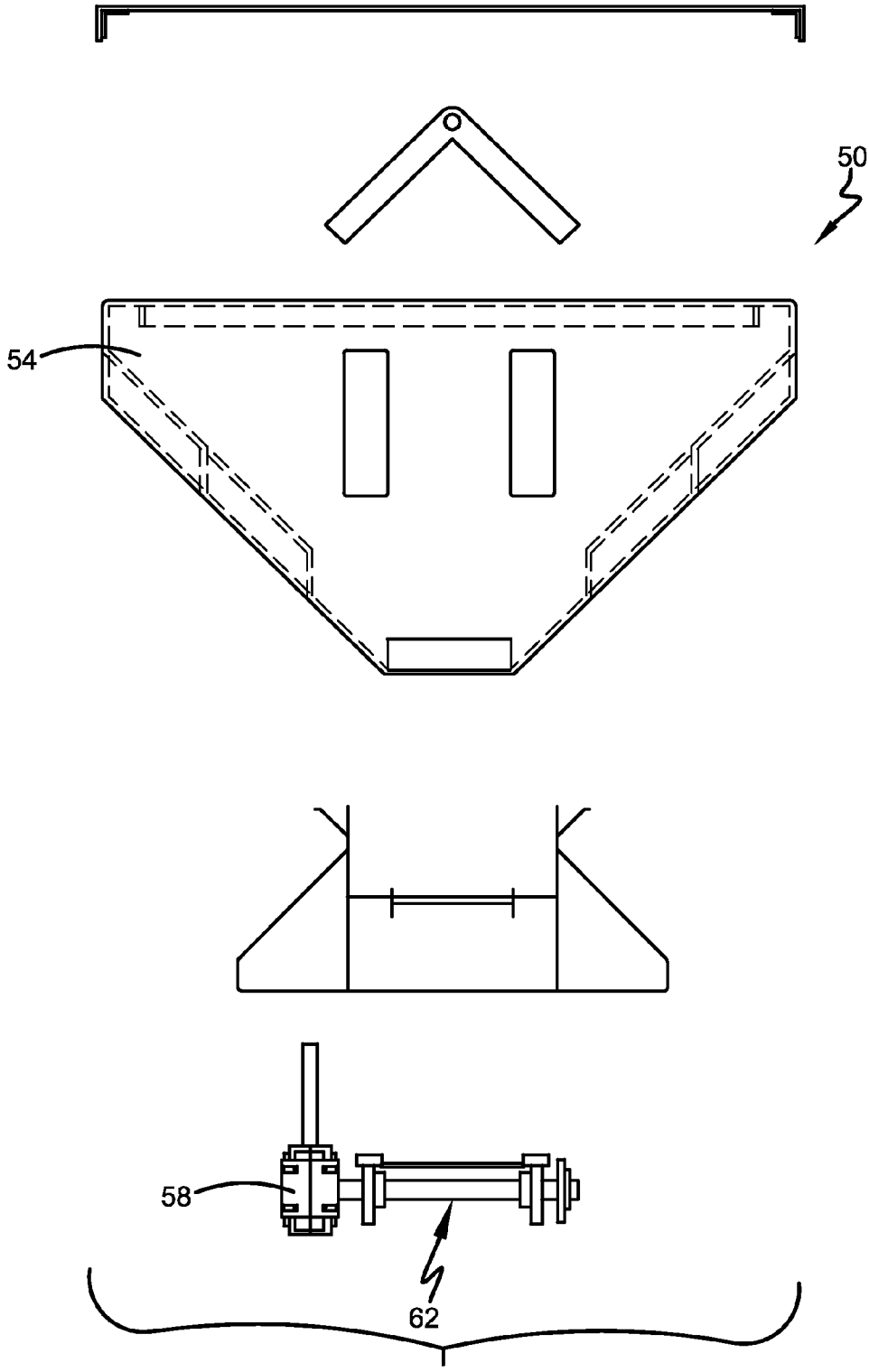
FIG. 6 is an exploded back view of an insert hopper type spreader assembly using a conveyor belt transfer component.

Thus far, the operation of the spreader assembly 50 has focused on controlling the operation of the spinner mechanism 56; but according to other embodiments of the invention, other spreader assembly components can also be controlled in addition to, or instead of, the spinner mechanism 56. It is well known, for example, to provide spreader assemblies 50 that—instead of being attached to the vehicle tailgate—utilize hoppers 54 that are received by and reside within the vehicle's truck bed. These devices, known as "insert hopper" spreaders, utilize conveyor belts 62 (as shown in FIG. 6) or horizontal augers (not shown) to move material to be spread onto a ground surface from the insert hopper to the spinner mechanism 56. As shown in FIG. 6, a conveyor belt motor **58*a* powers the conveyor belt 62 to transfer materials located in portions of the hopper located closer to the vehicle's passenger cabin to portions of the hopper that are closer to the vehicle's back bumper 12, wherein the particulate materials are delivered to an attached spinner mechanism 56—by any means known to a person of ordinary skill in the art—for distribution onto a ground surface 16. In much the same fashion described above, according to this embodiment of the invention, the controller—which is operatively connected to both the conveyor belt motor 58*a* and the spinner mechanism motor 58—regulates the operation of the conveyor belt motor 58*a* and the spinner mechanism motor 58 based on condition signals generated by the control signal generators 201. It is here contemplated to use the controller 200 to receive a condition signal 202 from a control signal generator 201** to control the operation of the conveyor belt motor and/or auger motor and thus to control the spreading of material onto the ground surface.

Numerous embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

Having thus described the invention, it is now claimed:

1. A system for spreading particulate materials, comprising:

an automotive vehicle;

a hopper, adapted to hold particulate materials for distribution over a ground surface;

a frame, operatively securing the hopper to the automotive vehicle;

a spinner mechanism, the spinner mechanism operatively attached to the hopper and adapted to distribute hopper particulate materials over a ground surface;

a spinner mechanism motor, operatively attached to the spinner mechanism, the spinner mechanism motor selectively providing rotational forces to the spinner mechanism; and a controller, operatively connected to the spinner mechanism motor, the controller being adapted to regulate operation of the spinner mechanism motor based on a condition signal received from one or more control signal generators chosen from the group consisting of: a vehicle brake light, a vehicle reverse light, or a vehicle gear shift.

2. The system for spreading particulate materials of claim 1, wherein the controller receives one or more condition signals via a hard-wired connection to a control signal generator chosen from the group consisting of: a vehicle brake light, a vehicle reverse light, or a vehicle gear shift.

3. The system for spreading particulate materials of claim 1, wherein the controller receives one or more condition signals via a wireless connection to a control signal generator chosen from the group consisting of: a vehicle brake light, a vehicle reverse light, or a vehicle gear shift.

4. The system for spreading particulate materials of claim 1, wherein the spinner mechanism is operatively attached to the frame and further comprises a spinner plate, the spinner plate being rotated by the spinner mechanism motor to distribute the particulate materials onto the ground surface.

5. The system for spreading particulate materials of claim 4, wherein the spinner mechanism further comprises a baffle plate preventing particulate materials from being propelled in the direction of the vehicle.

6. The system for spreading particulate materials of claim 5, wherein the spinner mechanism further comprises an auger operatively attached to the spinner mechanism motor and spinner plate; the auger residing at least partially within the hopper, and being rotated by the spinner mechanism motor in conjunction with the spinner plate.

7. The system for spreading particulate materials of claim 1, wherein the automotive vehicle further comprises a tailgate, and the frame operatively secures the hopper to the tailgate.

8. The system for spreading particulate materials of claim 1, wherein the automotive vehicle further comprises a rear bumper, and the frame operatively secures the hopper to the rear bumper.

9. The system for spreading particulate materials of claim 8, wherein the rear bumper further comprises a hitch, and the frame operatively secures the hopper to the hitch.

10. The system for spreading particulate materials of claim 1, further comprising:

a battery that is in operatively connected with the controller;

wherein the controller stops the rotation of the spinner mechanism motor and spinner mechanism by deactivating the battery so long as the controller is receiving a condition signal.

11. The system for spreading particulate materials of claim 10, wherein the controller also regulates the amount of power provided to the spinner mechanism motor, resulting in a change in rotational speed of the spinner mechanism.

12. The system for spreading particulate materials of claim 11, wherein the controller regulates the power provided to the spinner mechanism motor within the range of no power to full power.

13. The system for spreading particulate materials of claim 1, wherein the controller further comprises a timer device that temporarily suspends operation of the spinner mechanism motor after receiving a condition signal.

14. The system for spreading particulate materials of claim 13, wherein the duration of time that the timer device suspends operation of the spinner mechanism motor is dependent on the source of the condition signal.

15. The system for spreading particulate materials of claim 13, wherein the duration of time that the timer device suspends operation of the spinner mechanism motor can be adjusted by an operator.

16. A system for spreading particulate materials, comprising:

an automotive vehicle having a truck bed;

a hopper, adapted to be securely received within the truck bed and hold particulate materials for distribution over a ground surface; the hopper having a conveyor belt adapted to be powered by a conveyer belt motor and transfer particulate materials contained within the hopper to a spinner mechanism;

a spinner mechanism, the spinner mechanism operatively attached to the hopper and adapted to distribute hopper particulate materials over a ground surface;

a spinner mechanism motor, operatively attached to the spinner mechanism, the spinner mechanism motor selectively providing rotational forces to the spinner mechanism; and, a controller, operatively connected to the conveyor belt motor and the spinner mechanism motor, the controller being adapted to regulate operation of the conveyor belt motor and the spinner mechanism motor based on a condition signal received from one or more control signal generators chosen from the group consisting of: a vehicle brake light, a vehicle reverse light, or a vehicle gear shift.

17. A method for spreading particulate materials, comprising the steps of:

a) providing an automotive vehicle; a hopper, adapted to hold particulate materials for distribution over a ground surface; a frame, operatively securing the hopper to the automotive vehicle; a spinner mechanism, the spinner mechanism operatively attached to the hopper and adapted to distribute hopper particulate materials over a ground surface; a spinner mechanism motor, operatively attached to the spinner mechanism, the spinner mechanism motor selectively providing rotational forces to the spinner mechanism; and a controller, operatively connected to the spinner mechanism motor, the controller being adapted to regulate operation of the spinner mechanism motor based on a condition signal received from one or more control signal generators chosen from the group consisting of: a vehicle brake light, a vehicle reverse light, or a vehicle gear shift;

b) using the control signal generators to provide a condition signal in response to a change in vehicle condition;

c) transmitting the condition signal to the controller;

d) using the controller to process the condition signal to determine to what extent power to the spinner mechanism motor should be adjusted; and, e) using the controller to adjust the power provided to the spinner mechanism motor to a level within the range of no power to full power; and, f) repeating steps (a) through (e) according to a predetermined operational protocol to detect the presence of a condition signal.

* * * * *